United States Patent [19]

Moser

[11] 4,014,121

[45] Mar. 29, 1977

[54] PHOTOGRAPH HOLDER

[76] Inventor: Robert D. Moser, 115 Aztek, Council Bluffs, Iowa 51501

[22] Filed: Aug. 29, 1974

[21] Appl. No.: 501,596

[52] U.S. Cl. ..... 40/158 R; 40/124.1; 40/126 R

[51] Int. Cl.[2] ..... G09F 1/10

[58] Field of Search ..... 40/124.1, 160, 11, 10, 40/11 R, 10 R, 63, 124.4; D29/23 A; 248/459, 453

[56] References Cited

UNITED STATES PATENTS

| | | | |
|---|---|---|---|
| 685,405 | 10/1901 | Lamb | 40/10 R |
| 1,417,325 | 5/1922 | Hopp | 40/11 R |
| 1,473,800 | 11/1923 | Webb | 40/124.1 |
| 1,676,835 | 7/1928 | Oberheu | 40/125 A |
| 2,001.018 | 5/1935 | Fisher | 40/158 |
| 2,532,132 | 11/1950 | Vogel | 40/124.4 |
| 3,447,770 | 6/1969 | Gallamos | 248/453 |
| D134,887 | 1/1943 | Lenz | D29/23 A X |

*Primary Examiner*—G.E. McNeill
*Assistant Examiner*—Wenceslao J. Contreras

[57] ABSTRACT

A photograph holder comprising a base sheet of material from the surface of which four tabs protrude, two bottom tab means facing upwardly and having tabettes formed by notches therein and suitable for representing fingers of two upturned hands and two side tab means facing inwardly toward each other in combination with a second piece of material which can be a photograph disposed between said base piece and all, or at least one, of said tabs.

9 Claims, 4 Drawing Figures

PHOTOGRAPH HOLDER

FIELD OF THE INVENTION

This invention is in the field of photograph holders.

DESCRIPTION OF THE PRIOR ART

In the prior art devices have been proposed for holding cards or photographs which have had a sheet of base material with tabs struck from the sheet of base material and protruding therefrom at the terminal ends of the tabs have had excessive tab means as measured by the purposes of this invention.

None have had a base sheet free of extra tab means beyond one at each side of a photograph which can be used to illustrate a person's thumbs whereby a minimum amount of the side edges of a photograph are obscured by tab means so that the photograph is supported from falling downwardly and moving from side to side with a minimum of obscuring of the photograph along both the sides and the top of a photograph.

Heretofore card holders have been proposed in which a base is substantially covered with tabs in many positions whereby even if a photograph is placed in a position not be lapped by any but the tabs which are in equivalent position to the tabs of this invention, yet the slits in the base at the outer edges of other tabs in the base of such prior art devices are visible and distracting from the appearance of the combination of holder and photograph.

A particular object of the invention is to provide tab means adapted to go across and lapping the bottom edge of a rectangular photograph and which can be in the configuration of end portions of the fingers of the right and left hands of a person in combination with tab means at the sides of a photograph and lapping the right and left side edges of a photograph which are of a shape and decoration of the thumbs of a person, such person having his hands held in front of him with the palms upward.

A particular object is to provide a feature not found in the prior art in which the tab means which face upwardly are provided with eight protrusions, specifically, which can then be used to provide tab material of the outline of the ends of the fingers of a person with his hands held in front of him and facing palms upwardly so that each of the eight protrusions can represent a finger of the person and be decorated to illustrate the finger of a person.

SUMMARY OF THE INVENTION

A photograph holder comprising a base sheet of material from the surface of which four tabs protrude, two bottom tab means facing upwardly and having tabettes formed by notches therein and suitable for representing fingers of two upturned hands and two side tab means facing inwardly toward each other in combination with a second piece of material which can be a photograph disposed between said base piece and all, or at least one, of said tabs, said tabs being of one piece with said base sheet, said holder being free of extra side tab means in the space above said side tab means whereby a minimum amount of the side edges of a photograph are obscured.

DESCRIPTION OF THE PREFERRED EMBODIMENT

Figure 1:
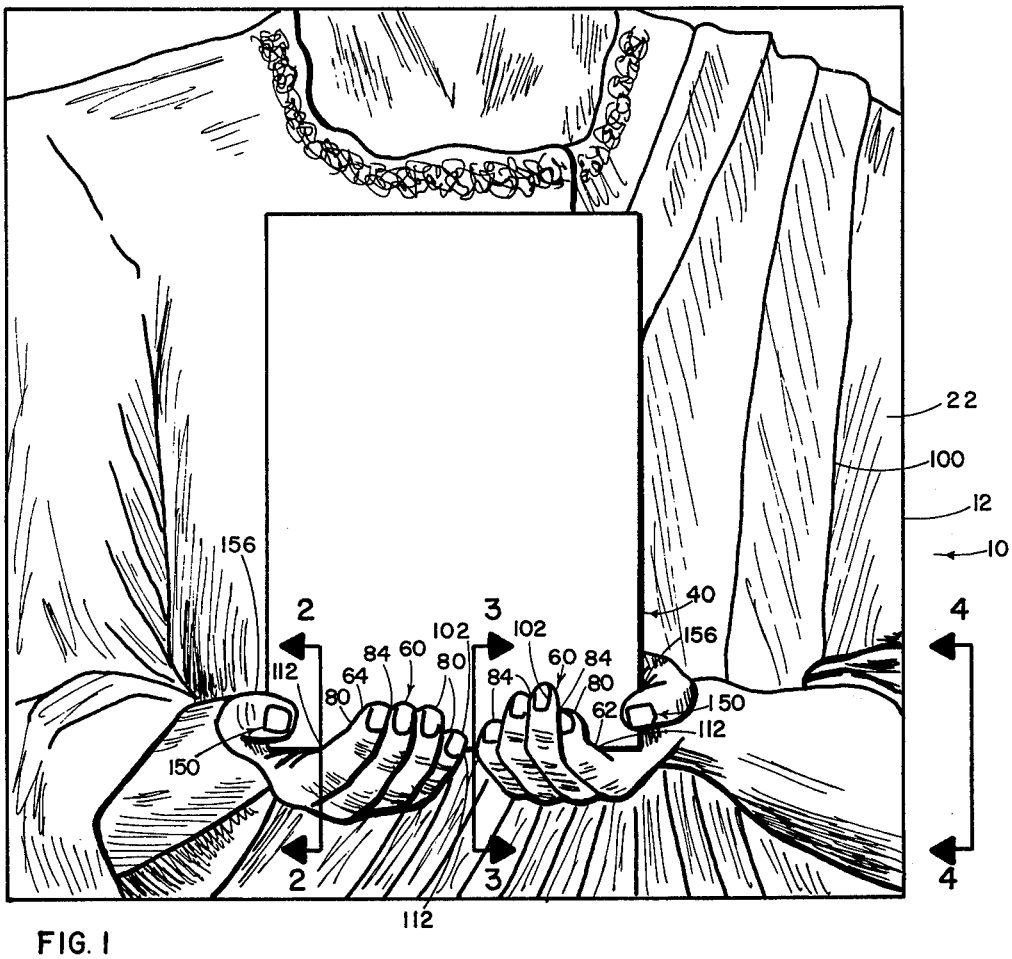
FIG. 1 is a frontal elevation of the photograph holder of this invention shown with a photograph in place thereon.

The photograph holder is generally indicated in FIG. 1 at 10, comprising a base sheet 12 of material having a forward side 22 for receiving thereagainst a photograph 40, which latter is planar on its two sides 42 and 44.

Bottom tab means 50 having right and left bottom tabs or tab means sections 60 are disposed on the forward side 22 of the base sheet 12, having attached ends 62 attached to the base sheet 12 and having terminal ends 64, which latter face generally in a same upward direction generally parallel to each other to lap an outer and opposite side 42 of the photograph.

The right and left bottom tab means sections 60 each comprise a plurality of tabettes 80, the tabettes 80 having terminal ends 82 spaced apart by notches 84. The exterior edge of the terminal end portions of each tabette is convex for serving as the tips of simulated fingers.

The base sheet has a visible coating 100 on its forward side illustrating at least a portion of the figure of a human being and the tabs or tab sections each have a coating 102 thereon illustrating portions of the fingers and thumbs of the same human being.

The majority of the notches 84 between the tabettes 80 extend inwardly of the respective tab section less than completely to a line between the ends 112 of the base 114 of the respective ones of said bottom tab means sections 60.

The photograph 40 is disposed in the position between the base sheet and the bottom tab means sections 60.

Figure 2:
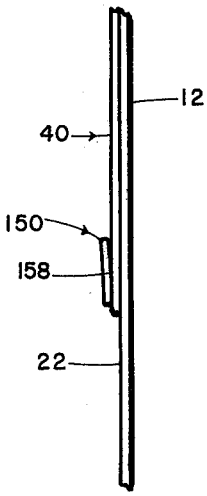
FIG. 2 is a sectional view taken along the line 2—2 of FIG. 1.
Figure 3:
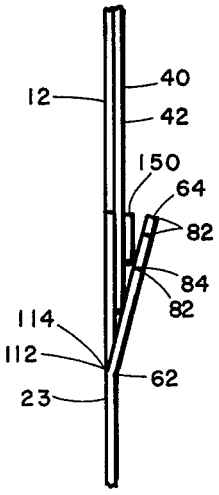
FIG. 3 is a sectional view taken along the line 3—3 of FIG. 1.
Figure 4:
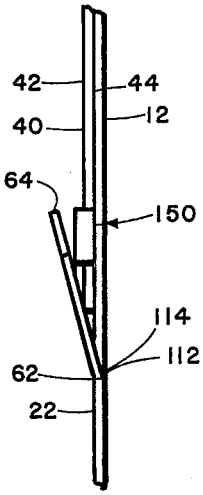
FIG. 4 is a view of the holder as seen from the right edge along the line 4—4 of FIG. 1.

Spaced right and left side tab means 150 are disposed on the forward side 22 of the base sheet 12 and have attached ends 156 attached to the base sheet 12 and having inner terminal ends 158 seen in FIG. 2.

The right and left tab means 150 extend from their attached ends 156 to their terminal ends 158 in directions opposing each other, the right and left side tab means 150 being disposed on the right and left sides of the bottom tab means sections 60.

All of the tab means sections 60 and 150 are formed of one piece of material with the sheet 12.

The photograph holder 10 is free of any extra other side tab means facing in directions parallel to the side tab means 150 and in addition thereto whereby a minimum amount of the side edges of the photograph 40 are obscured.

The right and left bottom tab means sections 60 and the right and left side tab means sections 150 together can be called right and left tab means sections (bottom and side) and each of these tab means sections 60 or 150 have inner terminal ends closer to the center of the photograph or card 40 and, therefore, closer to the center of the card-receiving area in which the card 40 is shown in FIG. 1, and each has outer ends attached to and integral with and of one piece with the base sheet 12.

Each of the inner ends of the tab means sections 60 or 150 is, therefore, further from a respective certain edge of the base sheet 12 than is the outer attached end of the same tab means section, the said respective certain edge being the closest edge of the sheet 12 to the respective tab means section 60 or 150 which said respective certain edge lies along a line extending from the inner terminal end of a respective tab means section to its attached outer end.

I claim:

1. A card holder comprising a base sheet of material having a forward side having a card-receiving area for receiving thereagainst a card having planar forward and rearward sides, right and left tab means sections disposed on said forward side of said base sheet, said tab means sections having inner and outer ends, each of said inner ends being further from a respective certain edge of said sheet than the outer end of the same tab means section, said tab means sections each having its said outer end attached to said base sheet and each tab means section being separate from said base sheet except at said attached outer end thereof whereby a card can be inserted between said tab means sections and said base sheet, said tab means sections being horizontally spaced apart when said base sheet is held in vertical position, said tab means being of one piece of material with said sheet, said base sheet having a visible coating thereon on its forward side, said coating illustrating at least a portion of the figure of a human being and each of said tab means sections having a portion of said coating thereon illustrating portions of the fingers of said human being, said respective certain edge being the closest edge of said sheet along a line extending from the said inner end of a respective tab means section to its said outer end.

2. The photograph holder of claim 1, said right and left tab means sections each comprising a plurality of tabettes, said tabettes having terminal ends spaced apart by notches, the terminal edge of each of said tabettes being convex on terminal end portions thereof for serving as the tips of simulated fingers.

3. The card holder of claim 2 in which the majority of said notches between said tabettes extend inwardly of the respective tab means section less than completely to a line between the ends of the base of respective ones of said bottom tab means.

4. The card holder of claim 1 having said right and left tab means sections attached to said base sheet at their lower ends and being attached to said base sheet at places disposed substantially at the same horizontal level when said base sheet is held in vertical position whereby a rectangular card having a horizontal lower edge can be upheld by said tab means sections when its lower edge is inserted between said tab means sections and said base sheet, said human figure having open hands held in a palms-up position.

5. The card holder of claim 4 further comprising spaced right and left side tab means disposed on said forward side of said base sheet and having attached ends attached to said base sheet and having terminal ends, said right and left tab means extending from their attached to their terminal ends in directions opposing each other, said right and left side tab means being disposed on the right and left sides of said bottom tab means.

6. The photograph holder of claim 5 further comprising a photograph disposed in the position described between said base sheet and said tab means.

7. The photograph holder of claim 5 further comprising said holder being free of any other tab means facing in directions parallel to said side tab means and in addition thereto whereby a minimum amount of the side edges of a photograph are obscured.

8. The photograph holder of claim 5 further comprising said right and left tab means each being of one piece of material with said base sheet.

9. The card holder of claim 4 further comprising a photograph disposed in the position described between said base sheet and said bottom tab means sections.

* * * * *